US008372783B2

(12) United States Patent
Chandra et al.

(10) Patent No.: US 8,372,783 B2
(45) **Date of Patent: *Feb. 12, 2013**

(54) PERMEABLE NON-WOVEN FABRIC BASED PACKAGING FOR CUT FLOWERS

(76) Inventors: Shubham Chandra, Milford, MA (US); Bhavna Chandra, Milford, MA (US)

( * ) Notice: Subject to any disclaimer, the term of this patent is extended or adjusted under 35 U.S.C. 154(b) by 47 days.

This patent is subject to a terminal disclaimer.

(21) Appl. No.: 12/852,534

(22) Filed: Aug. 9, 2010

(65) Prior Publication Data

US 2011/0083366 A1 Apr. 14, 2011

Related U.S. Application Data

(63) Continuation-in-part of application No. 12/051,844, filed on Mar. 19, 2008, now Pat. No. 7,772,139.

(51) Int. Cl.

| | |
|---|---|
| ***A01N 3/02*** | (2006.01) |
| ***A01G 9/02*** | (2006.01) |
| ***A61K 31/74*** | (2006.01) |
| ***A61K 9/14*** | (2006.01) |
| ***B01D 53/22*** | (2006.01) |
| ***B65D 85/00*** | (2006.01) |
| ***B65D 85/50*** | (2006.01) |

(52) U.S. Cl. ..... 504/114; 47/84; 96/4; 96/11; 206/423; 424/78.08; 424/486; 426/106

(58) Field of Classification Search ..... 504/114
See application file for complete search history.

(56) References Cited

U.S. PATENT DOCUMENTS 4,842,875 A * 6/1989 Anderson ..... 426/118

OTHER PUBLICATIONS

R.M. Rudnucki, J. Nowak, D.M. Goszczynska, "Cold storage and transportation conditions for cut flowers cuttings and potted plants", Acta Horticulturae, 298 (1991), pp. 225-230.*

* cited by examiner

*Primary Examiner* — Sue Liu
*Assistant Examiner* — Nathan W Schlientz

(57) ABSTRACT

Packaging using Gas Permeable Non-Woven Fabric based Film extends the shelf life and vase life of fresh cut flowers by changing the atmosphere in which these living products are stored and respires. The high oxygen and carbon dioxide permeability of the Gas Permeable Non-Woven Fabric based Film establishes an ideal atmosphere for the cut flowers, and therefore extends its shelf life and vase life. The establishment of lower oxygen and carbon dioxide atmospheres inside packages using Gas Permeable Non-Woven Fabric based film, also leads to reduction in the respiration rate of the cut flowers. The reduction in the respiration rate prevents loss of moisture, production of metabolic heat, and yellowing, browning, reduction in production levels of ethylene. Thus the created atmosphere is able to extend shelf life, maintain high quality and preserve nutrients of cut flowers items by naturally regulating respiration of said flower.

3 Claims, 3 Drawing Sheets

PERMEABLE NON-WOVEN FABRIC BASED PACKAGING FOR CUT FLOWERS

RELATIONSHIP TO COPENDING APPLICATIONS

This application is a continuation-in-part of application Ser. No. 12/051,844, filed Mar. 19, 2008 now U.S. Pat. No. 7,772,139. The examiner for this application was TORRES VELAZQUEZ, NORCA LIZ. This application claims benefits of the Ser. No. 12/051,844.

FIELD OF THE INVENTION

The invention relates to a Gas Permeable Non-Woven Fabric based packaging for cut flowers, with high permeability towards oxygen and carbon dioxide, and is directed more particularly to such a packaging system as is suitable for extending the shelf life and vase life of cut flowers.

BACKGROUND

Cut Flowers like any produce are a living tissue that derives energy primarily by exchanging gases with its surroundings through the process of respiration. Respiration involves the consumption of atmospheric oxygen, carbohydrates, and organic acids by the plant tissue, and the consequent production and release of metabolic energy, heat, carbon dioxide and water vapor.

The packaging systems provided in the art range from basic low density polyethylene bags to fairly sophisticated high oxygen transmission rate gas permeable membranes. Modified Atmosphere Packaging (MAP) and related technologies such as Modified Interactive Packaging (MIP) have been used widely and successfully with fresh produce for a number of years, but have not been used on any extensive scale with cut flowers.

SUMMARY

Some shortcomings of such packaging systems include the inability to establish ideal oxygen and carbon dioxide atmosphere levels inside the packaging simultaneously. Typically, since the permeation rate for such packages for oxygen and carbon dioxide is same, if the oxygen atmosphere inside the package is 5% the carbon dioxide atmosphere will be 21−5=16%. So in essence the sum of oxygen and carbon dioxide levels will be 21%. Therefore, atmospheres such as 2% Oxygen and 5% Carbon Dioxide cannot be achieved.

Further, many of the packaging systems in use control and/or inhibit the growth of ethylene levels inside the package containing produce. Ethylene is a ripening agent, which is produced naturally in fresh fruits and vegetables as they respire. However, controlling the ethylene levels does not guarantee shelf life or, in the case of flowers, vase life extension, because the oxygen levels and carbon dioxide levels need to be controlled simultaneously. Reduced oxygen levels caused increased metabolic activity and hence reduction in shelf life, and increased carbon dioxide levels leads to tissue softening, and fungal and bacterial growth.

Still further, use of polyethylene bags do not have the adequate permeability needed for long term storage of produce and/or flowers. Issues such as development of anaerobic conditions when the oxygen levels go below 1% and development of high carbon dioxide levels permanently injure the produce; make the use of low density plastic bags incapable in shelf life extensions.

Still further, use of vapor barrier bags has been used to extend the shelf life of cut roses. However, due to the inability of vapor barrier bags to modify the oxygen and carbon dioxide levels inside the package containing the cut flowers, the cut flowers do not have extended shelf life extensions. The reason being, due to higher oxygen levels the respiration rate of the product is higher, and so the metabolic activity of the flowers is not being controlled and leading to shorter shelf life. The carbon dioxide levels in such a package is also atmospheric level, 0.03%, therefore any fungal and/or bacterial growth cannot be controlled.

Still further, for sea shipping of cut roses, there is a need for dry flowers only. Due to weight issues and issues related to fungal and bacterial growth, cut flowers cannot be shipped with any moisture levels, making it impossible to extend shelf life of cut flowers during transit and shipping modes. This thereafter has an effect on the subsequent vase life of cut roses.

Accordingly, there remains room for improvement in many areas of shelf life and vase life extension technologies.

An objective of the invention is, therefore, to provide a packaging system with a high permeable polymer coated non-woven fabric based packaging, which in essence by naturally establishing modified atmospheres, carbon dioxide levels of 3 to 5% and oxygen levels of 5% to 15%, inside a package containing fresh produce/flower can effectively extends its shelf/vase life. The hydrophobic nature of the Gas Permeable Non-Woven Fabric film allows moisture released during the natural respiration of cut flower retained within the package, ensuring the flowers remain fresher and do not dehydrate during shipping. The carbon dioxide levels of 3-5% inside these packages, inhibit the fungal and bacterial growth, leading to shelf life extensions. Lower oxygen levels due to the Gas Permeable Non-Woven Fabric based packaging ensures the metabolic activity of the cut flowers are reduced and adds to shelf life extensions. The combination of lower oxygen levels, higher carbon dioxide levels and moisture ensures the cut flowers have maximized shelf life extensions and are fresher. The reduction in the respiration rate prevents loss of moisture, production of metabolic heat, and yellowing, browning, reduction in production levels of ethylene. Thus the created atmosphere is able to extend shelf life, maintain high quality and preserve nutrients of cut flowers items by naturally regulating respiration of said flower.

Produce is a living tissue that derives energy primarily by exchanging gases with its surroundings through the process of respiration. Respiration involves the consumption of atmospheric oxygen, carbohydrates, and organic acids by the plant tissue, and the consequent production and release of metabolic energy, heat, carbon dioxide and water vapor. As the produce consumes oxygen and gives off carbon dioxide, an equilibrium gas concentration is established in the package. The gas permeable non-woven film (gas permeable film) is capable of providing different package permeabilities in order to maintain specific oxygen and carbon dioxide levels in a package and maintain this optimum atmosphere even as the temperature is changing. As the produce or other agricultural item consumes oxygen and give off carbon dioxide, the equilibrium gas concentration is established in the package. This process is a function of the permeability of the polymer and its selectivity ratio of oxygen to carbon dioxide. Thus, the created atmosphere is adapted to extend shelf life, maintain high quality and preserve nutrients of fresh produce items by naturally regulating respiration of the agricultural items.

Thus the created atmosphere is able to extend shelf life, maintain high quality and preserve nutrients of fresh produce items by regulating the respiration of the targeted items. Gas Permeable Non-Woven Fabric based Film, which allows for Carbon Dioxide gas to move in and out of the packaging at a rate many times greater than that of Oxygen. By reducing the atmospheric levels of Oxygen and increasing the atmospheric levels of Carbon Dioxide within the packaging, the ripening of fresh produce and fresh cut flowers can be delayed, the produce's respiration and ethylene production rates can be reduced, the softening of the produce can be retarded, and various compositional changes associated with produce ripening can be slowed down.

An embodiment of the invention includes a method for extending the shelf life and vase life of cut flowers during transit comprising storing said cut flowers at a temperature no lower than 32° F. and no higher than 71.6° F. in a package including a gas permeable film consisting of:

a. a non-woven fabric substrate, the substrate adapted for transmission of gases; and b. a polymer coating on the non-woven fabric substrate;

i. the polymer coating having an oxygen permeability of at least 110,000 cc/100 $in^2$/day/atm, with a maximum permeability of 611,111 cc/100 $in^2$/day/atm at 13° C.; and ii. the polymer coating having a carbon dioxide permeability of at least 350,000 cc/100 $in^2$/day/atm, with a maximum permeability of 3,888,889 cc/100 $in^2$/day/atm at 13° C.;

wherein (i) said polymer coating forms a uniform spread on the substrate, (ii) the level of carbon dioxide inside the package is no lower than 2% and no higher than 10%, and (iii) the level of oxygen inside the package is no lower than 2% and no higher than 15%.

A particular configuration of the highly permeable non woven fabric based film is obtained by coating nonwoven fabric such as one with 50% polyester and 50% rayon, with a thin layer of polymer, the fabric based system gets its structural strength from the fabric and the permeability from the polymer. This approach enables to reduction in the thickness of the polymer coating on the fabric, and yet maintains enough strength with the fabric, and therefore enhancing its Oxygen Permeation Rate to 110,000 cc/100in2/day/atm, or even up to 611,111 cc/100in2/day/atm, with carbon dioxide permeability of at least 350,000 cc/100in2/day/atm, with a maximum permeability of 3,888,889 cc/100in2/day/atm at 13° C.

With the above and other objects in view, as will hereinafter appear, a feature of the present invention is the provision of a packaging system including a polyethylene bag, with a hole cutout at the center of the bag, thereof adapted to receive a permeable film, including an adhesive patch for binding the film to the cutout part of the plastic bag, an elastic band for closing the mouth of the plastic bag.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Figure 1:
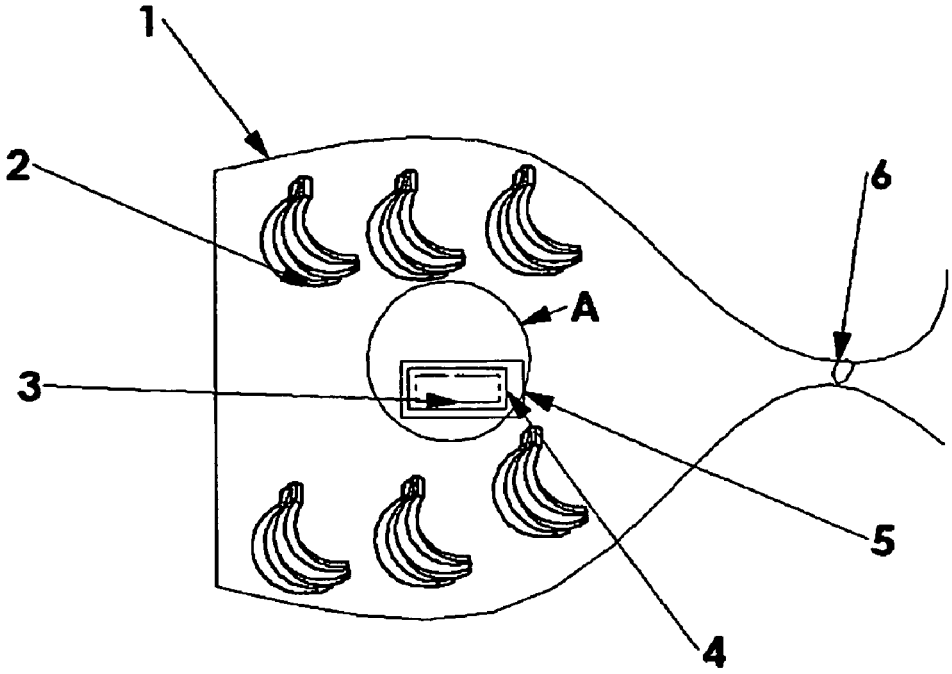
FIG. 1 is a simplified illustration of one form of packaging system with the Gas Permeable Non-Woven Fabric based Film illustrative of an embodiment of the invention.

Depicted below and in accordance with the drawings are example of produce storage and more particularly to such a packaging system as is suitable for extending the shelf life of fresh fruits and vegetables (both whole and fresh cut), and vase life of flowers. The configurations below include formation of the gas permeable non-woven fabric film, or membrane, for providing particular permeability according to a predetermined transfer rate and packaging configurations employing the gas permeable non-woven fabric for storing and transporting produce products stored therein.

The gas permeable non-woven fabric based film (film) is employed in packaging for extending the shelf life of various fresh fruits and vegetables and vase life of fresh cut flowers by changing the atmosphere in which these living products are stored and respires. The high oxygen and carbon dioxide permeability of the film establishes an ideal atmosphere for the specific perishable item, and therefore extends its shelf life. The establishment of lower oxygen and carbon dioxide atmospheres inside packages using the film also leads to reduction in the respiration rate of the perishable items. The reduction in the respiration rate prevents loss of moisture, production of metabolic heat, and yellowing, browning, reduction in production levels of ethylene. Therefore, the created atmosphere is able to extend shelf life, maintain high quality and preserve nutrients of fresh produce items by naturally regulating respiration of said produce/flower.

Formation of the Gas Permeable Non-Woven Fabric based Film fabrication process includes creation of these films. The components for the film include polydimethyl siloxane (PDMS) base (This polydimethyl siloxane either consists of >60.0% Dimethyl siloxane, dimethylvinyl-terminated, 30.0-60.0% Dimethylvinylated and trimethylated silica, and 1.0-5.0% Tetra(trimethylsiloxy) silane, or >60.0% Dimethyl siloxane, dimethylvinyl-terminated and 30.0-60.0% Dimethylvinylated and trimethylated silica.), and curing agent mixed in the ratio 10:1, non-woven fabric (50% polyester, 50% Rayon). A mayer Rod (#3, which creates a film thickness of 0.27 MIL) was also used.

b. Mix the PDMS base and curing agent in a 10:1 ratio measured by weight c. De-gas the polymer in a desiccator for approximately 30 minutes. This removes any air bubbles resulting from the mixing process.

d. Pour this mixture on a non woven fabric, and roll the Mayer Rod #3 to form a uniform spread. Mayer rod #3 deposits a thickness of 0.27 MIL on the fabric.

e. Preheat oven for 20 minutes at 170° F. (76.6° C.).

f. Cure the PDMS-coated fabric at 170° F. (76.6° C.) for 20 minutes to promote cross-linking.

Process to design packages using the Gas Permeable Non-Woven Fabric based film. The respiration rates, ideal atmospheres, and ethylene sensitivities for various perishable items, including fresh fruits and vegetables and fresh cut flowers have been documented by University of California, Davis. The information available was utilized in designing these packages.

a. Identify the perishable item that is to have a shelf life extension. Items identified and tested have included, broccoli, cilantro, bananas, whole corn, lettuce, tomatoes, red seedless grapes, mushrooms, strawberries and cut flowers (roses, orchids, gerbera and tulips).

b. For example, in the case of bananas, the respiration rates, ideal atmospheres and ideal storage temperatures were identified. The Oxygen transmission Rates (OTR) and Carbon Dioxide transmission Rates (COTR) for the Gas Permeable Non-Woven Fabric based film have already been tested by an independent test agency, Mocon Inc., of Minneapolis, Minn. The OTR and COTR values define the permeability for particular agricultural items, for example by measuring the weight of the produce, such as bananas. In a particular configuration, the OTR and COTR for these films at 13.3° C. (an ideal temperature for bananas) tested at 111,735 and 699,000 cc/100in^2/day/atm respectively. Using the weights, respiration rates, ideal atmospheres, COTR and OTR of these films, the surface area needed for these films can be calculated. Take the produce bag, can be low density polyethylene bag (LDPE), high density polyethylene bag (HDPE), or any other non-porous material based, used to store bananas, and cut a hole in the bag equivalent to the surface area needed for the film.

c. Using a good adhesive tape (such as electrical insulating tape), attach the Gas Permeable Non-Woven Fabric based film at the position where the produce bag has a hole.

d. Place the cut flower, inside the bag.

e. Using a regular elastic band close the opening of the produce bag.

The produce bag with the Gas Permeable Non-Woven Fabric based Films will naturally attain the ideal atmospheres needed for cut flowers, and therefore will extend its shelf life. Testing results have successfully been able to extend the life of cut flowers to 28 days.

As the produce or other agricultural items respire, they consume oxygen and give off carbon dioxide, and an the equilibrium gas concentration is established in the package. This process is a function of the gas permeable film permeability and carbon dioxide to oxygen selectivity ratio. Thus, the created atmosphere (typically 2-20% oxygen and 5-15% carbon dioxide) is able to extend shelf life, maintain high quality and preserve the nutrients by naturally regulating respiration of the produce and/or agricultural items. Lower oxygen levels substantially around 2% reduce the metabolic activity of the perishable item (produce) and elevated carbon dioxide levels prevent rotting and fungal growth. Lower levels of oxygen also reduce the ethylene production of the perishable items. Predominantly perishable items with high sensitivity towards ethylene benefit from avoidance of elevated ethylene levels. Ethylene promotes ripening of bananas, and therefore lower ethylene levels tend to extend the shelf life of bananas. By changing the surface area and the thickness of the gas permeable film, the permeabilities to oxygen and carbon dioxide can be controlled, and therefore longer shelf life agricultural items such as fruits and vegetables is promoted.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

Referring to FIG. 1, it will be seen that an illustrative configuration includes a non-perforated polyethylene bag 1 with perishable item 2, with a hole cutout 3 at the center of the bag, thereof adapted to receive a permeable film 4, including an adhesive patch 5 for binding the permeable film to the cutout part of the plastic bag and an elastic band 6 for closing the mouth of the plastic bag.

Figure 2:
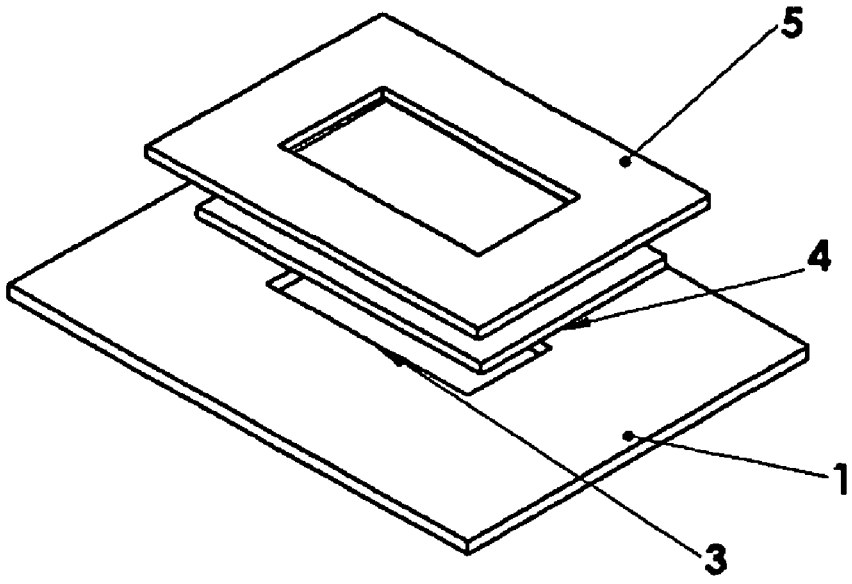
FIG. 2 is a an illustration of the oxygen and carbon dioxide levels inside the package storing cut flowers.
Figure 3:
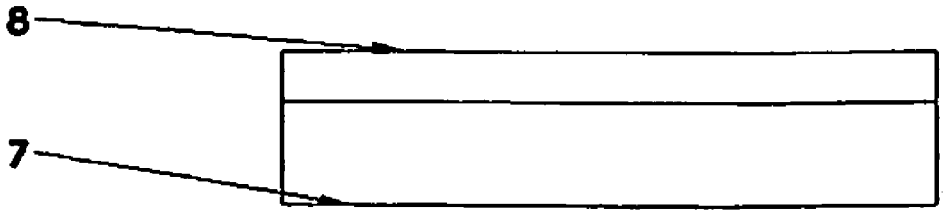
FIG. 3 is an illustration of the Gas Permeable Non-Woven Fabric based film.

FIG. 2 is a an illustration an enlarged view of matter in circle A of FIG. 1; and Referring to FIG. 3, it will be seen that an illustrative example includes a non-woven fabric 7 (50% polyester, 50% Rayon) with a coating of polymer 8 consisting of polydimethyl siloxane either consists of >60.0% Dimethyl siloxane, dimethylvinyl-terminated, 30.0-60.0%Dimethylvinylated and trimethylated silica, and 1.0-5.0% Tetra(trimethylsiloxy) silane, or >60.0% Dimethyl siloxane, dimethylvinyl-terminated and 30.0-60.0% Dimethylvinylated and trimethylated silica, and curing agent mixed in the ratio 10:1.

The increased use of sea containers to transport flowers long distances under proper temperatures is considered a commercial standard. It is therefore conceivable that Gas Permeable Non-Woven Fabric based packaging would likely have a greater chance of success when used for storage and/or sea container transport assuming that only species and cultivars that benefit from this are utilized.

Depicted below are examples of the gas permeable non-woven fabric employed for storage and transportation of produce and vegetative specimens in accordance with the teachings herein. Additional information concerning post harvest conditions for various produce items may be obtained from the website for the University of California, Davis Department of Plant Sciences and other sources as known in the art.

EXAMPLE 1

During shipments of cut flowers from Quito, Ecuador to UC Davis, Calif., with Six rose cultivars ('Cherry Brandy', 'Vendela', 'Freedom', 'Engagement', 'Blush' and 'High & Magic'), all at the same cut stage, were harvested. The roses were treated normally at farm level in terms of hydration, bunching, and temperature management prior to being packed in the Gas Permeable Non-Woven Fabric based packaging. A second box bottom, slightly smaller than the normal box bottom, was used for the packaging. Flowers were put into the slightly smaller box bottom, secured by a strap as with all the boxes, and then the slightly smaller box bottom and flowers were slid into the Gas Permeable Non-Woven Fabric based packaging and sealed with elastic bands. Finally, the smaller bottom box bottom with the flowers, encased in the Gas Permeable Non-Woven Fabric based packaging, were placed into the normal box bottom and covered with a normal box lid. Flower temperatures at the time they were placed into the boxes averaged 3.2 C. (37-38 F.). One bunch (25 stems) of each cultivar (five bunches total) were placed into each box for a total of 150 flowers per box.

After 21 Days of storage at 37-38 F., each bunch was opened and inspected, stems recut to 18 inches under water, lower foliage removed, and placed into a 1.0% flower food solution (Floralife Crystal Clear Powder) made with tap water (alkalinity of 85 ppm). The flowers were then placed in a postharvest vase life room that provided 18 hours per day of cool white fluorescent light at 72-74F. Seven stems of each cultivar were used per treatment and replicate for a total of 36 jars, each containing 900 ml of the flower food solution. Flower food solution was replenished when needed.

After 21 Days of storage at 37-38 F., each bunch was opened and inspected, stems recut to 18 inches under water, lower foliage removed, and placed into a 1.0% flower food solution (Floralife Crystal Clear Powder) made with tap water (alkalinity of 85 ppm). The flowers were then placed in a postharvest vase life room that provided 18 hours per day of cool white fluorescent light at 72-74F. Seven stems of each cultivar were used per treatment and replicate for a total of 36 jars, each containing 900 ml of the flower food solution. Flower food solution was replenished when needed.

In addition, it should be noted that the flowers, plastic sleeves and inside of the bags in the Gas Permeable Non-Woven Fabric based packaging were visibly much wetter than the other treatments. The Gas Permeable Non-Woven Fabric based packaging reduced water loss from the flowers by 10% as compared to the conventional shipping carton. Thus, following shipment, the flowers were judged to have a better appearance than flowers kept in a regular carton box. However, no visible Botrytis was noted on these flowers.

Observations made during the vase life test suggests that flower opening for 'Engagement' flowers was more and exhibited bigger flowers.

Within 'Engagement', the honest significant difference (hsd or Tukey) multiple range test at 0.05 revealed that 'Engagement' in Gas Permeable Non-Woven Fabric based packaging was better than control treatments.

Within 'Freedom', at an estimated hsd level of 0.07, 'Freedom' in Gas Permeable Non-Woven Fabric based packaging was better than control treatments.

EXAMPLE 2

During shipments of cut flowers from Quito, Ecuador to UC Davis, Calif., with Six rose cultivars ('Cherry Brandy', 'Vendela', 'Freedom', 'Engagement', 'Blush' and 'High & Magic'), all at the same cut stage, were harvested. The roses were treated normally at farm level in terms of hydration, bunching, and temperature management prior to being packed in the Gas Permeable Non-Woven Fabric based packaging. A second box bottom, slightly smaller than the normal box bottom, was used for the packaging. Flowers were put into the slightly smaller box bottom, secured by a strap as with all the boxes, and then the slightly smaller box bottom and flowers were slid into the Gas Permeable Non-Woven Fabric based packaging and sealed with elastic bands. Finally, the smaller bottom box bottom with the flowers, encased in the Gas Permeable Non-Woven Fabric based packaging, were placed into the normal box bottom and covered with a normal box lid. Flower temperatures at the time they were placed into the boxes averaged 3.2 C. (37-38 F.). One bunch (25 stems) of each cultivar (five bunches total) were placed into each box for a total of 150 flowers per box.

After 28 Days of storage at 37-38 F., each bunch was opened and inspected, the Gas Permeable Non-Woven Fabric based packaging treated roses looked better than the controls for all three cultivars, whereas the controls looked more dehydrated.

TABLE 1

Oxygen and carbon dioxide levels inside Gas Permeable Non-Woven Fabric based packaging, Example 1

| Treatment | Oxygen (%) DAY 7 | Carbon dioxide (%) DAY 7 | Oxygen (%) DAY 21 | Carbon dioxide (%) DAY 21 |
|---|---|---|---|---|
| Gas | 17.46 | 1.23 | 16.29 | 2.39 |
| Permeable | 11.20 | 5.64 | 9.89 | 6.71 |
| Non-Woven | 12.91 | 4.12 | 15.45 | 2.78 |
| Fabric based packaging | 14.71 | 2.93 | 13.88 | 3.90 |
| Room air | 18.76 | 0.00 | 19.00 | 0.00 |

EXAMPLE 3

During shipments of 15 boxes of cut flowers in Gas Permeable Non-Woven Fabric based packaging from Naivasha, Kenya to Milford, Mass., with 24 rose cultivars ('Diadem', 'Magenta', 'Akito Sweet', 'Moonzun', 'Wild Calypso', 'Wild thing', 'Sri', 'Sweet Sher', 'Poeme', 'Angela', 'Jambo', 'Texana', 'Chelsea', 'Yes', 'Chelsea royal', 'Crazy Sher', 'Inka', 'Bella Rose', 'Mary cleir', 'Inka royal', 'Ryia', 'Red Calypso', 'Red Champ', and 'Sunny Sher'), all at the same cut stage, were harvested. The roses were treated normally at farm level in terms of hydration, bunching, and temperature management prior to being packed in the Gas Permeable Non-Woven Fabric based packaging. Upon receipt of this shipment, using a Mocon Gas Analyzer the oxygen and carbon dioxide readings of these packages were monitored. Three protocols of the gas permeable non-woven fabric based packaging were used. Protocol A1 had two Gas Permeable Non-Woven Fabric based films of diameter 2.14 inches each. Protocol A2 had two Gas Permeable Non-Woven Fabric based films of diameter 2.5 inches each. Protocol A3 had two Gas Permeable Non-Woven Fabric based films of diameter 3 inches each.

TABLE 2

Oxygen and carbon dioxide levels inside Gas Permeable Non-Woven Fabric based packaging, Example 3

| Treatment | Oxygen (%) DAY 4 | Carbon dioxide (%) DAY 4 | Oxygen (%) DAY 18 | Carbon dioxide (%) DAY 18 | Oxygen (%) DAY 22 | Carbon dioxide (%) DAY 22 |
|---|---|---|---|---|---|---|
| Protocol A1 | 16.07 | 2.75 | 11.4 | 6.48 | 11.02 | 8.82 |
| Protocol A2 | 16.62 | 2.31 | 9.5 | 9.08 | 6.1 | 11.22 |
| Protocol A3 | 15.88 | 2.75 | 13.22 | 5.5 | 4.41 | 4.2 |
| Room air | 18.76 | 0.00 | 19.00 | 0.00 | 19.00 | 0.00 |

The data collected suggests the storage temperature of these roses during transit varied between 18 and 22° C. The respiration rate of roses at these temperatures is 137 ml/kg-h, suggesting the roses life would deteriorate drastically, if these temperatures were maintained at any length of time. For comparison sake the respiration rate of roses at 5° C. is 26 ml/kg-h. However, the Protocols A1, A2 and A3 were designed to account for this temperature abuse. Protocol A3 maximized the shelf life extensions for the above mentioned cultivars of roses, except for diadem, and Poeme. Both of these varieties failed to bloom. The other 22 varieties had shelf life extensions of 24 days using the Protocol A3 of the Gas Permeable Non-Woven Fabric based packaging.

What is claimed is:

1. A method for extending the shelf life and vase life of cut flowers during transit comprising storing said cut flowers at a temperature no lower than 32° F. and no higher than 71.6° F. in a package including a gas permeable film consisting of:

a. a non-woven fabric substrate, the substrate adapted for transmission of gases; and b. a polymer coating on the non-woven fabric substrate;

i. the polymer coating having an oxygen permeability of at least 110,000 cc/100 in2/day/atm, with a maximum permeability of 611,111 cc/100 in2/day/atm at 13° C.; and ii. the polymer coating having a carbon dioxide permeability of at least 350,000 cc/100 in2/day/atm, with a maximum permeability of 3,888,889 cc/100 in2/day/atm at 13° C.;

wherein (i) said polymer coating forms a uniform spread on the substrate, (ii) the level of carbon dioxide inside the package is no lower than 2% and no higher than 10%, and (iii) the level of oxygen inside the package is no lower than 2% and no higher than 15%.

2. The method of claim 1 comprising a shelf life for cut roses no lower than 20 days and no higher than 30 days.

3. The method of claim 1 comprising a vase life for cut roses, subsequent to storage for 20 days, no less than 8.6 days and up to 14.4 days.

* * * * *